US009884403B2

(12) United States Patent
Maurer

(10) Patent No.: US 9,884,403 B2
(45) Date of Patent: Feb. 6, 2018

(54) MACHINING ARRANGEMENT FOR DRILLING AT LEAST ONE HOLE INTO A WORKPIECE

(71) Applicant: Microwaterjet AG, Aarwangen (CH)

(72) Inventor: Walter Maurer, Oftringen (CH)

(73) Assignee: MICROWATERJET AG, Aarwangen (CH)

( * ) Notice: Subject to any disclaimer, the term of this patent is extended or adjusted under 35 U.S.C. 154(b) by 0 days.

(21) Appl. No.: 15/165,009

(22) Filed: May 26, 2016

(65) Prior Publication Data

US 2016/0279760 A1 Sep. 29, 2016

Related U.S. Application Data

(62) Division of application No. 14/184,806, filed on Feb. 20, 2014, now Pat. No. 9,381,663.

(30) Foreign Application Priority Data

Feb. 21, 2013 (CH) ..... 49313

(51) Int. Cl.
*B26F 1/26* (2006.01)
*B26F 3/00* (2006.01)
(Continued)

(52) U.S. Cl.
CPC ..... *B24C 1/045* (2013.01); *B24C 7/0015* (2013.01); *B26F 1/26* (2013.01); *B26F 3/004* (2013.01); *B26F 3/008* (2013.01)

(58) Field of Classification Search
CPC ..... B24B 1/04; B24C 7/003; B24C 7/015; B24C 7/045; B26F 1/26; B26F 2/004
See application file for complete search history.

(56) References Cited

U.S. PATENT DOCUMENTS 4,818,834 A 4/1989 Rupert
4,873,414 A 10/1989 Ma et al.
(Continued)

FOREIGN PATENT DOCUMENTS

CN 101142050 3/2008
EP 0984265 8/2000
(Continued)

OTHER PUBLICATIONS

European Search Report dated May 17, 2013, corresponding to the Foreign Priority Application No. 4932013.
(Continued)

*Primary Examiner* — Timothy V Eley
(74) *Attorney, Agent, or Firm* — Young & Thompson

(57) ABSTRACT

A machining arrangement for drilling a hole into a front wall section of a workpiece by way of a machining jet, the front wall section being located in front of a rear wall section of the workpiece, as seen looking in a drilling direction, the rear wall section being disposed with an intermediate space at a distance from the front wall section, the machining arrangement being switchable between a continuous mode, in which the machining jet formed from liquid and abrasive material continuously impinges on the workpiece, and a pulsed mode, in which the machining jet is pulsed, so that the impingement of at least on of said liquid and said abrasive material on the workpiece is recurrently interrupted, the machining arrangement including a controller which is programmed and configured so that the hole is drilled at least partially in the pulsed mode.

27 Claims, 7 Drawing Sheets

(51) Int. Cl.
*B24C 7/00* (2006.01)
*B24C 1/04* (2006.01)

(56) References Cited

U.S. PATENT DOCUMENTS

| | | | |
|---|---|---|---|
| 4,955,164 | A | 9/1990 | Hashish et al. |
| 5,049,722 | A | 9/1991 | Corfe et al. |
| 5,140,127 | A | 8/1992 | Stroud et al. |
| 5,154,347 | A | 10/1992 | Vijay |
| 6,054,673 | A | 4/2000 | Chen |
| 6,120,351 | A | 9/2000 | Zeng |
| 6,339,208 | B1 | 1/2002 | Rockstroh et al. |
| 6,547,645 | B2 | 4/2003 | Devine, II |
| 6,800,829 | B1 | 10/2004 | Nimmons |
| 7,041,933 | B2 | 5/2006 | Forrester et al. |
| 7,705,266 | B2 | 4/2010 | Koseki et al. |
| 7,841,084 | B2 | 11/2010 | Meier |
| 8,237,082 | B2 | 8/2012 | Beck et al. |
| 2004/0023596 | A1 | 2/2004 | Devine, II |
| 2004/0064930 | A1 | 4/2004 | Gunn et al. |
| 2005/0092620 | A1 | 5/2005 | Mavliev et al. |
| 2009/0084235 | A1 | 4/2009 | Kata et al. |
| 2009/0110877 | A1 | 4/2009 | Bernard et al. |
| 2011/0076405 | A1 | 3/2011 | Raji et al. |
| 2015/0135512 | A1 | 5/2015 | Niblock et al. |

FOREIGN PATENT DOCUMENTS

| | | |
|---|---|---|
| EP | 1408196 | 4/2004 |
| EP | 2301730 | 3/2011 |
| WO | 9213679 | 8/1992 |
| WO | 2012065580 | 5/2012 |

OTHER PUBLICATIONS

European Search Report dated Apr. 22, 2014, from corresponding EP application.

China Office Action dated Mar. 7, 2017; Application No. 201410060308.5.

MACHINING ARRANGEMENT FOR DRILLING AT LEAST ONE HOLE INTO A WORKPIECE

BACKGROUND OF THE INVENTION

The present invention relates to a machining arrangement for drilling at least one hole into a workpiece.

Drilling into a workpiece is difficult, among other things, when the same has one or more cavities or, generally speaking, wall sections, which are arranged offset behind one another. The rear wall section, as seen looking in the drilling direction, for example, impairs drilling in the front wall section. In addition, measures must be taken which prevent damage to this wall section when the penetration is made in the front wall section. Workpieces that are this difficult to drill exist in the form of turbine blades, for example, in which a plurality of holes are to be provided for cooling.

It is known to drill holes into such workpieces by way of laser or electrical discharge machining (see, for example, U.S. Pat. No. 7,041,933 B1). These methods have the disadvantage that the material ablation takes place by heat development, which may result in undesirable damage to sensitive layers. Electrical discharge machining has the further disadvantage that it can only be used for conductive workpieces.

A known alternative is that of using liquid machining jets for drilling. This type of machining has the advantage that no heat develops during drilling and non-conductive workpieces can also be machined. It is known from EP 1 408 196 A2 to introduce the machining head, from which the machining jet exits during drilling, into a cavity of the workpiece and to drill the hole from the inside out. This method has the disadvantage that it can only be used for special geometries of workpieces and holes. Drilling is in particular not possible when the cavity is not accessible to the machining head and/or the drilling direction is oriented perpendicularly to the workpiece surface, for example.

From U.S. Pat. No. 4,955,164 a method for drilling a hole by means of an abrasive jet acting permanently on the workpiece is known. Thus, it is difficult to stop the impact of the jet precisely when it penetrates the workpiece.

A method is disclosed in WO 92/13679 A1, wherein an ultrasonic generator is used to produce cavitation bubbles in a machining jet formed from pure water. The disclosed method is not suitable to drill holes in a workpiece such that undesirable damages are prevented.

SUMMARY OF THE INVENTION

It is an object of the present invention to provide a machining arrangement for drilling at least one hole into a workpiece having wall sections disposed behind one another by way of a liquid machining jet, wherein the machining arrangement can be used for a variety of workpiece geometries and substantially prevent undesirable wall damage.

This object is achieved by a machining arrangement, wherein the hole is drilled at least partially by the machining jet impinging on the front wall section in a pulsed manner.

This machining arrangement allows economical drilling of the hole. If the penetration is made by way of a pulsed machining jet, the drilling can be terminated in a timely fashion, and damage to the wall section arranged behind the drilled wall section, as seen looking in the drilling direction, can be substantially avoided. Moreover, a drilling direction is possible which points from the outer side of the workpiece to the inside, so that the method can be used for a variety of workpiece geometries and drilling directions.

Preferably, the machining arrangement drills the hole at least partially by using liquid and abrasive material.

So as to reduce the risk of wall damage even further, the machining arrangement preferably uses a free-flowing protective agent, which is for instance also used to generate the machining jet, to fill the workpiece and/or a sensor device to detect the time at which the machining jet penetrates the front wall section.

BRIEF DESCRIPTION OF THE DRAWINGS

The invention will be described hereafter based on exemplary embodiments with reference to the figures.

In the drawings.

DETAILED DESCRIPTION OF THE PREFERRED EMBODIMENTS

Figure 1:
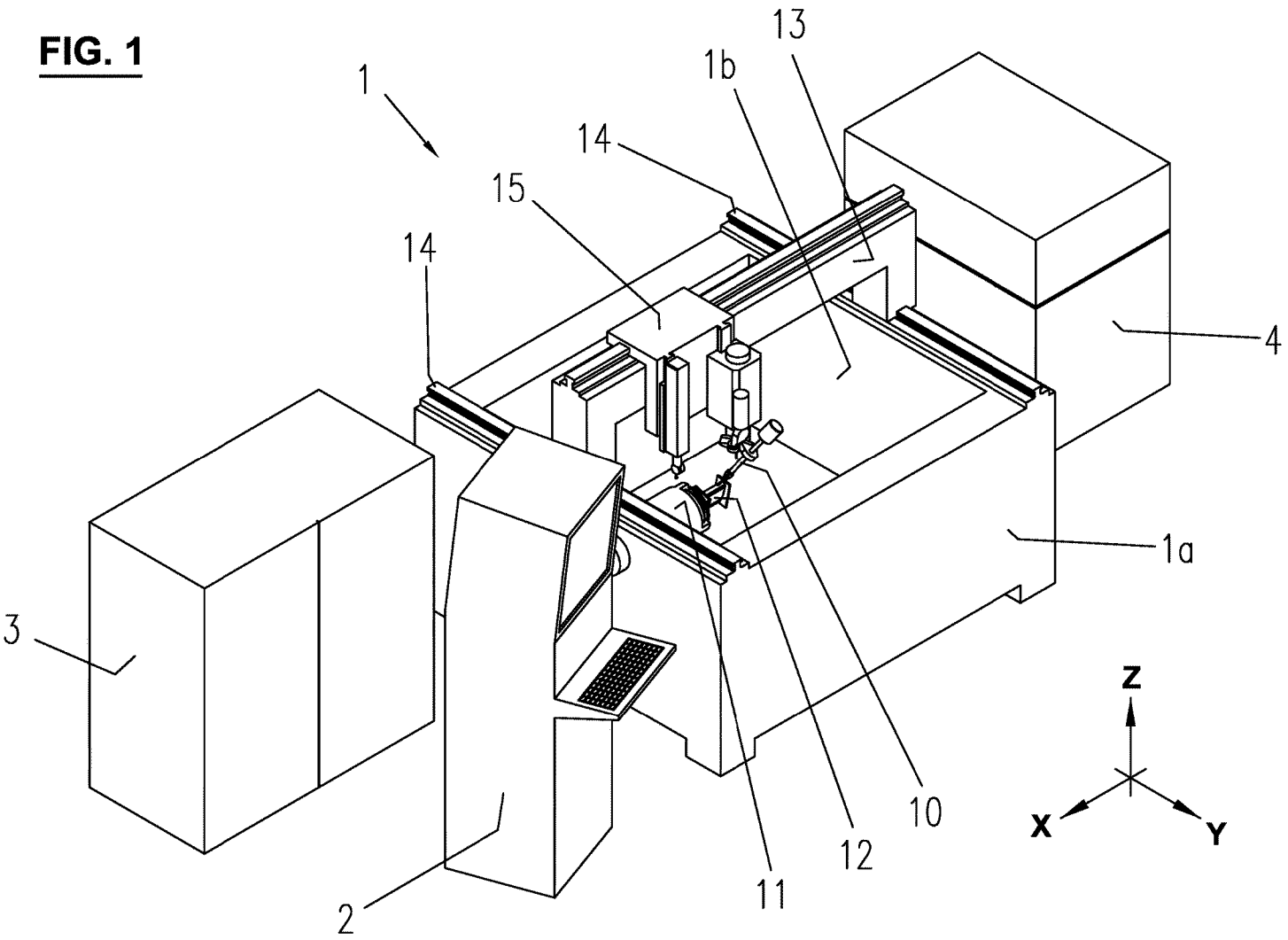
FIG. 1 is a perspective view of an arrangement for drilling holes.

FIG. 1 shows an arrangement for machining a workpiece comprising a machining device 1, an operating device 2, a control cabinet 3 and a pump device 4.

The machining device 1 comprises a machining head 10, from which a machining jet exits during operation, and a holding device 11 for holding a workpiece 12. In the present exemplary embodiment, the machining device 1 is configured to generate a machining jet made of a liquid containing or not containing abrasive material. For example, water is suitable as the liquid, and the abrasive material is sand, for example. Other media are also possible as the liquid, for example oil. Furthermore, it is conceivable to add one or more admixtures to the liquid, for instance polymers, to improve the efficacy of the machining jet.

The machining device 1 further comprises a basin 1*b*, which is delimited by walls 1*a* and in which the holding device 11 together with the workpiece 12 is disposed and into which the machining head 10 protrudes.

The operating device 2 comprises units for outputting and/or inputting information, such as a keyboard, monitor and/or pointing device. The control cabinet 3 comprises the controller, which includes means for data processing and for generating control signals for operating the machining device 1. The controller is equipped with a program, during the execution of which the method described below for drilling holes into the workpiece 12 can be carried out. The controller is designed in the form of a CNC controller, for example.

The pump device 4 is configured to conduct the liquid, such as water or another medium, under high pressure to the machining head 10.

The machining head 10 can be moved in several axes; in the present exemplary embodiment it is 5 axes. For this purpose the machining head 10 includes a bridge 13, which can be moved in the Y axis and on which a carrier 15 is disposed. Rails 14, which are disposed on the walls 1*a*, are used to displace the bridge 13, for example. The carrier 15 carries the machining head 10 and can be displaced in the X axis, and thus transversely relative to the Y axis, along the bridge 13.

Figure 2:
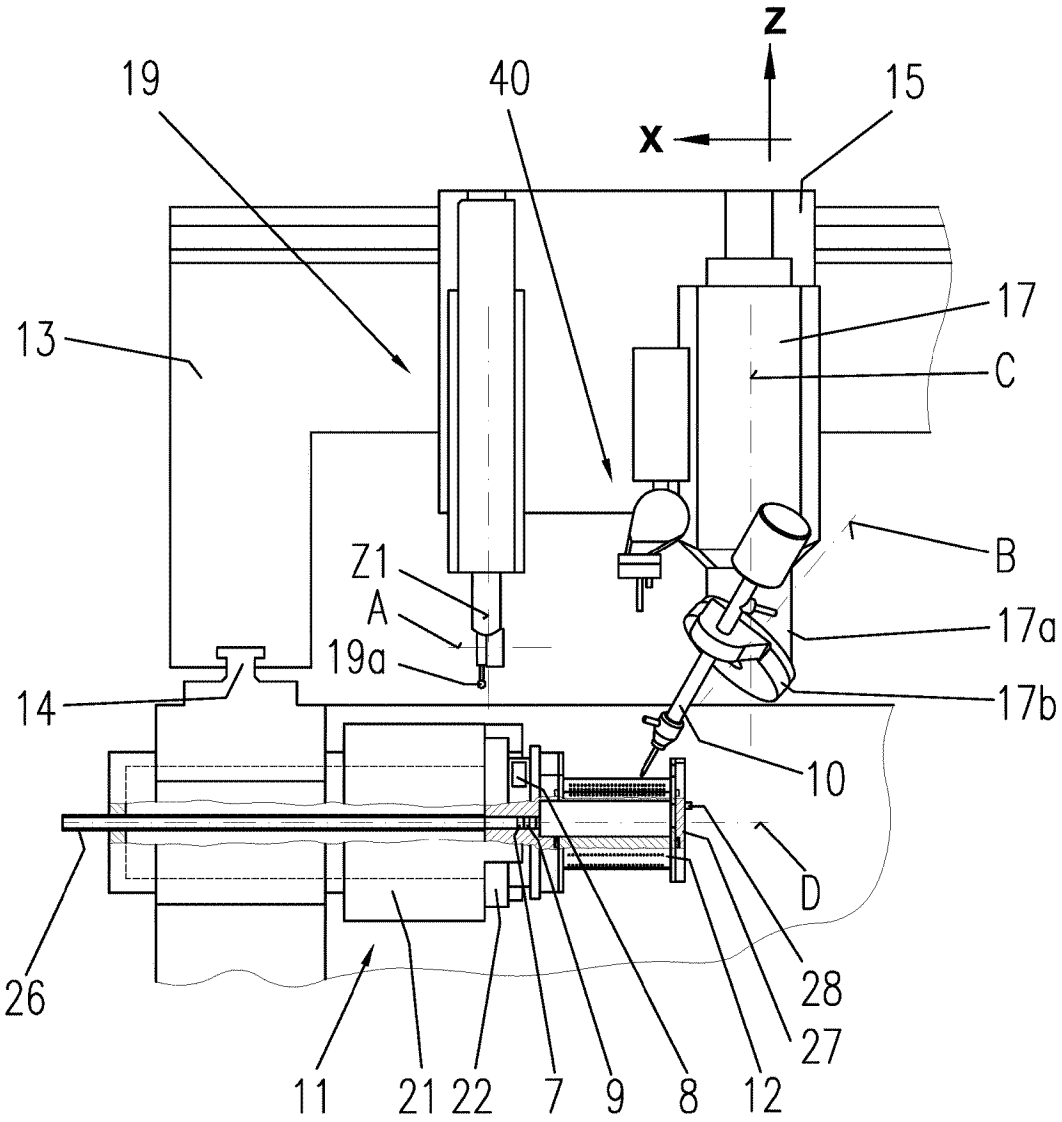
FIG. 2 is a partially cut detailed view of FIG. 1.

As the detailed view in FIG. 2 shows, the machining head 10 is held on the carrier in such a way that it can be displaced in the Z axis, and thus transversely relative to the X axis. The machining head 10 is further mounted rotatably about two rotational axes B and C. The rotational axis C here extends in the direction of the Z axis. The two axes B and C are disposed at an angle with respect to each other. The angle is adapted to the application purpose of the arrangement and may range between 45 and 90 degrees. A drive unit 17 disposed on the carrier 15 is used to move the machining head 10 in the Z, B and C axes. The drive unit 17 comprises a rotating head 17*a*, which can be rotated about the C axis and has an oblique end. This end comprises a rotating part 17*b*, which can be rotated about the B axis and on which the machining head 10 is held.

Moreover, a feed device 40 for adding abrasive material and a measuring device 19 are disposed on the carrier 15.

The measuring device 19 is used to measure the workpiece 12 and includes a measuring laser, for example. The measuring device 19 includes a measuring head 19*a*, which here is disposed on the carrier 15 in such a way that it can be displaced along an axis Z1, which is parallel to the Z axis, and rotated about a rotational axis A disposed transversely relative thereto.

Prior to processing, the exact position of the workpiece surface may be still undefined, for example due to the manufacturing type of the workpiece 12, for example if the same is produced as a casting, and/or as a result of chucking. Using the measuring device 19, the contours of the workpiece 12 can be detected so that the machining head 10 can be precisely positioned in relation to the workpiece surface and the holes can be drilled in the desired locations of the workpiece 12.

The holding device 11 here includes a chuck 21, in which an adapter part 22 for holding the workpiece 12 is chucked. The holding device 11 has a rotational axis D, about which the workpiece 12 can be rotated.

The arrangement here is designed specifically for drilling holes into the workpiece 12, which comprises one or more cavities or, generally speaking, wall sections, which are disposed offset behind one another. The holding device 11 includes a port 26 for introducing a liquid as the protective agent, with which the workpiece 12 is to be filled during machining. Preferably the same liquid, such as water, is used for the machining jet and for the protective agent. For sealing purposes, the free end of the workpiece 12 is provided with a flange 27, which comprises suitable seals. Valve means 28 are provided, for example on the flange 27, which allow the workpiece 12 to be vented when the same is filled with the protective agent. Moreover, the valve means 28 can be designed so that the protective agent can escape from the workpiece 12 when the pressure p of the protective agent exceeds a certain threshold. For this purpose the valve means 28 include a pressure control valve.

Sensor means 7, 8, 9 are provided for monitoring the process. These are designed in such a way that in particular the time can be detected when the machining jet penetrates the wall of the workpiece 12.

The sensor means used here include a pressure sensor 7 for measuring the pressure p of the protective agent in the workpiece 12, and an acoustic transducer 9, by way of which sound propagating in the liquid protective agent can be detected. If the protective agent used is water, the acoustic transducer 9 is designed in the form of an underwater microphone, for example. According to FIG. 2, the sensors 7 and 9 are located at the adapter part 22. However, they may also be disposed in other locations for measuring pressure and sound. The acoustic transducer 9 can be protected from excessive pressure load during operation by a suitable design of the valve means 28.

The sensor means further include a sensor 8 which is located outside the workpiece 12, for example on the holding device 11, as shown in FIG. 2. However, it can also be disposed in a different location of the machining device 1.

During machining, structure-borne noise is created in the machine elements, which results in oscillations. An acoustic emission sensor is thus suited as sensor 8, for example. Since the machining jet exits the machining head 10 at high speed, measurable sound is likewise generated, which propagates in the air. It is thus also possible, either additionally or alternatively, to use a microphone as the sensor 8.

When the machining jet penetrates the wall of the workpiece 12 during drilling, the measurement signals supplied by the sensor means 7, 8, 9 change noticeably (see the explanation regarding FIG. 7 below).

Figure 3:
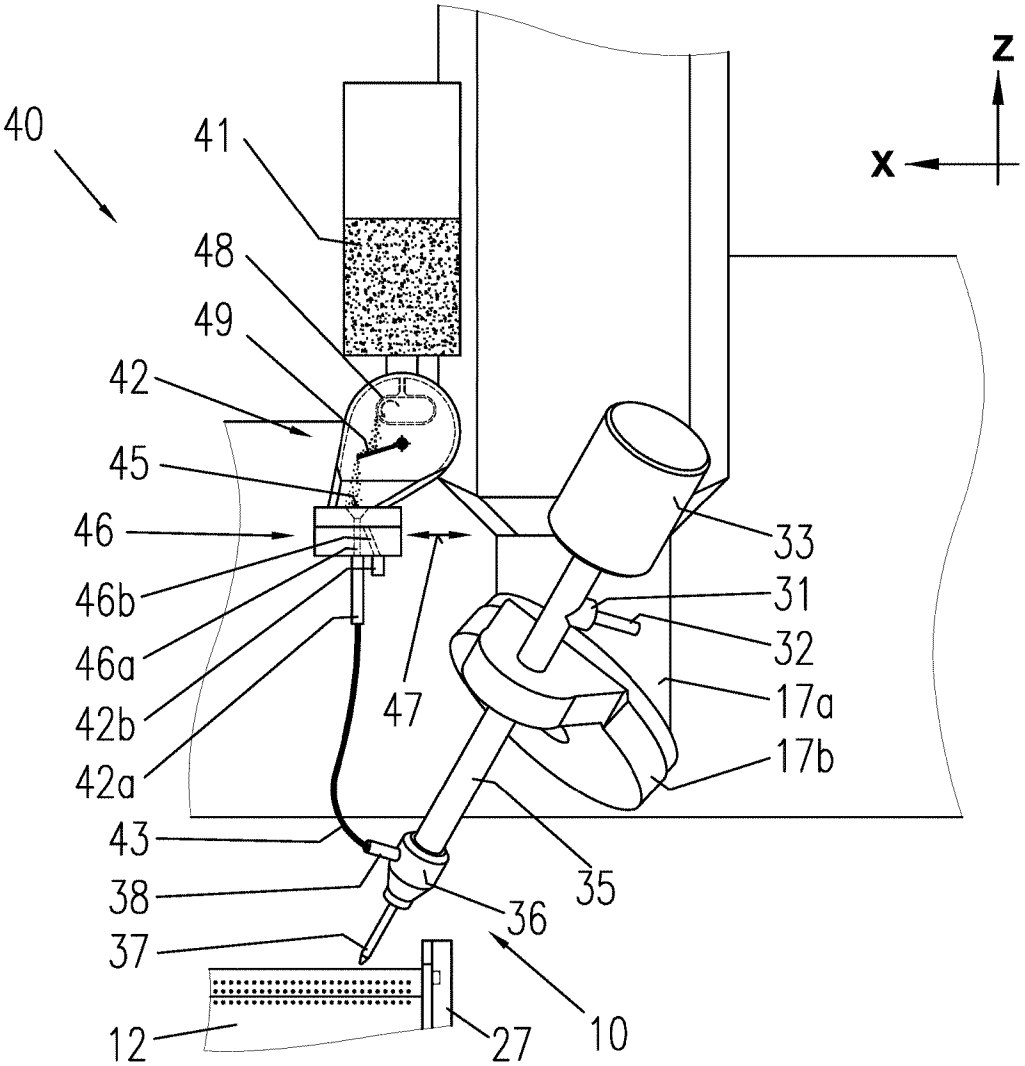
FIG. 3 is a detailed view of FIG. 2.

As is also shown in FIG. 3, a high-pressure valve 31 for switching the machining jet on and off is located at the inlet-side end of the machining head 10. This valve includes an inlet 32, into which the pump device 4 introduces the liquid under high pressure via a high-pressure line (not shown). An actuating device 33 placed thereon is used to switch the high-pressure valve 31.

The machining head 10 is rotatably mounted in this example. The high-pressure line is coupled to the inlet 32 by way of conventional components, such as helical high-pressure lines and rotational joints, which allow the machining head 10 to be pivoted relative to the stationary pump device 4.

So as to form the machining jet, the machining head 10 further comprises a collimation tube 35, which is used to guide the introduced liquid and to steady the flow thereof and which is connected to the focusing tube 37 by way of an intermediate part 36. A nozzle for converting the pressure energy into kinetic energy and a mixing chamber, into which an inlet connector 38 leads for supplying abrasive material, are located in the intermediate part 36. The focusing tube 37 is used to accelerate the abrasive material and to align and concentrate the liquid or the liquid/abrasive mixture.

The feed device 40 is also apparent from FIG. 3. It comprises a container 41 for storing the abrasive material and a metering device 42 having a feed outlet 42*a*, which is connected to the inlet connector 38 on the intermediate part 36 via a line 43.

The metering device 42 is configured to allow the quantity $Q_A$ of abrasive material (for example, in units of grams per minute) exiting the feed outlet 42*a* to be set in a controlled manner. In this example, the metering device 42 is designed in such a way that a switch can be made between the two states, $Q_A$ equal to zero and $Q_A$ greater than zero, in a short time $t_U$. The metering device 42 is in particular configured so that abrasive material exits the feed outlet 42*a* in a constant $Q_A$ in the state $Q_A>0$. The switching time $t_U$ is typically in the range of 10 to 200 milliseconds, and preferably in the range of 20 to 100 milliseconds.

In the present exemplary embodiment, the metering device 42 includes a conveyor belt 48, which is shown in dotted fashion in FIG. 3 and which revolves and can be driven, an inlet 45, which is preferably delimited by tapering walls, a sliding part 46, which comprises two channels 46*a* and 46*b*, which are shown in dotted fashion in FIG. 3, and a drain 42*b*. The metering device 42 further includes a measuring means 49, which is designed to determine the quantity $Q_A$. The measuring means 49 serves as a scale and, for this purpose, comprises a strain gauge, for example. This strain gauge extends obliquely, so that abrasive material dropping off the conveyor belt 48 can continue to drop to the sliding part 46. The strain gauge deforms as a function of the quantity of abrasive material dropping thereon and supplies a corresponding measurement signal.

The sliding part 46 can be displaced back and forth relative to the inlet 45 between two displacement positions, as is indicated by the arrow 47. The displacement of the sliding part 46 is carried out by way of an electric drive or compressed air, for example.

In the one displacement position of the sliding part 46, the channel 46*a* leading to the feed outlet 42*a* is connected to the inlet 45. During operation, the abrasive material conveyed by the conveyor belt 48 drops to the inlet 45 as a result of gravitation, where it reaches the machining head 10 via the line 43 and finally is admixed to the liquid. In the other displacement position of the sliding part 46, the channel 46*b* leading to the drain 42*b* is connected to the inlet 45, so that the delivered abrasive material reaches the outside via the drain 42*b* and drops into the basin 1*b*. The channel 46*b* thus acts as a bypass channel. Optionally, the drain 42*b* may be connected to a line so as to conduct the abrasive material to a collection container.

As an alternative to a translational movement of the sliding part 46, it is also conceivable to design the metering device 42 in such a way that the sliding part 46 can be rotated relative to the container 41 back and forth between two positions.

The use of the movable sliding part 46 has the advantage that it is possible to switch back and forth between the two positions in a short time $t_U$ and the conveyor belt 48 permanently remains in operation, so that fluctuations in the $Q_A$ are avoided, and abrasive material, which is to be admixed to the liquid, is conveyed as uniformly as possible to the machining head 10 via the line 43.

In a simpler embodiment, the sliding part 46, together with the drain 42*b*, may also be dispensed with, so that the supply of abrasive material to the machining head 10 is interrupted, for example by stopping the conveyor belt 48.

Other embodiments of the metering device 42 are also conceivable, so as to selectively allow and interrupt the supply of abrasive material.

For example, the metering device 42 can include a device that allows adjustable volumetric delivery of the abrasive material. For this purpose, a drivable rotating part is provided, for example, which conducts abrasive material through a channel during the rotation. It is also conceivable to draw in and/or redirect abrasive material by way of negative pressure.

Figure 4:
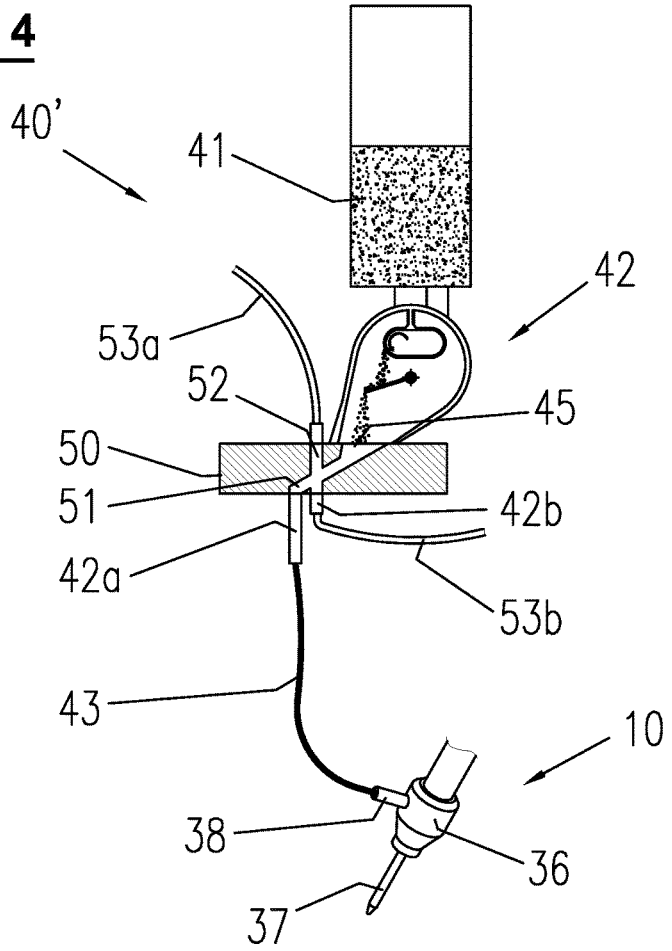
FIG. 4 shows a partially cut front view of one variant of a feed device for an arrangement according to FIG. 1.

FIG. 4 shows one variant of a feed device 40', in which an intersecting part 50 having a channel 51 that is intersected by an air duct 52 is provided, instead of the sliding part 46 of FIG. 3. The two ends of the air duct 52 are connected to lines 53*a*, 53*b* so as to generate a negative pressure in the drain 42*b* as needed.

In the state of admixing, abrasive material makes its way to the feed inlet 42*a* from the inlet 45 via the channel 51 and then to the machining head 10 via the line 43. If admixing should be interrupted, a negative pressure is generated in the air duct 52, so that the abrasive material is no longer conducted to the feed inlet 42*a*, but through the lower end of the air duct 52 to the drain 42*b* and then is drawn through the line 53*b*. The air duct 52 thus acts as a bypass channel.

Optionally, measures are taken to prevent the metering device 42 from clogging when liquid from the machining head 10 backs up in the line 43 and the abrasive material is thus wetted.

Figure 5:
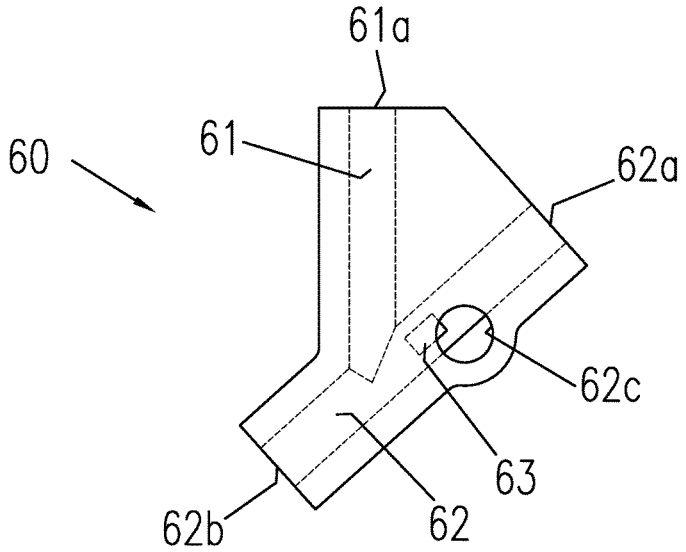
FIG. 5 is a side view of a branching part that can be used in the arrangement according to FIG. 1.

FIG. 5 shows a branching part 60, which is used to prevent such clogging and is installed into the line 43, for example. The branching part 60 comprises a channel 61, which has an inlet 61*a* and leads into an auxiliary channel 62 having an inlet 62*a* and an outlet 62*b*. For example, the inlet 61*a* is connected to the feed inlet 42*a* of the metering device 42. The outlet 62*b* is connected to the machining head 10. A line for supplying a process gas, such as air, is connected to the inlet 62*a*. An auxiliary outlet 62*c* runs in the auxiliary channel 62. The pressure of the process gas is set in such a way that, during operation, more process gas is supplied through the inlet 62*a* than is discharged in the outlet 62*b*. A portion of the process gas thus flows out of the auxiliary outlet 62*c*.

The process gas supplied via the inlet 62*a* can be conditioned so as to support the machining operation. For example, the process gas is conditioned in such a way that it has the lowest possible moisture level, thus preventing clogging by abrasive material.

A sensor 63, by way of which liquid flowing back from the machining head 10 can be detected, is also disposed in the auxiliary channel 62. The sensor 63 is designed as a capacitive sensor, for example.

During normal operation, the abrasive material makes its way from the feed device 40 via the inlet 61*a* and the channels 61 and 62 to the outlet 62*b* and then to the machining head 10. If a flow back occurs now, liquid thus makes its way through the outlet 62*b* into the auxiliary channel 62, where it is detected by the sensor 63. In this case, the operation of the arrangement is interrupted, and the user can eliminate the cause of the flow back.

A method for drilling holes into a workpiece is described hereafter.

The workpiece 12 to be machined comprises at least two wall sections, which are disposed at a distance from and, as seen looking in the drilling direction, behind one another. When a hole is drilled into the first wall section, the second wall section is located behind the first wall section, as seen looking in the drilling direction. When the machining jet penetrates the first wall section, it should generally be avoided that the jet impinges on the second wall section, thereby damaging the same.

Figure 6:
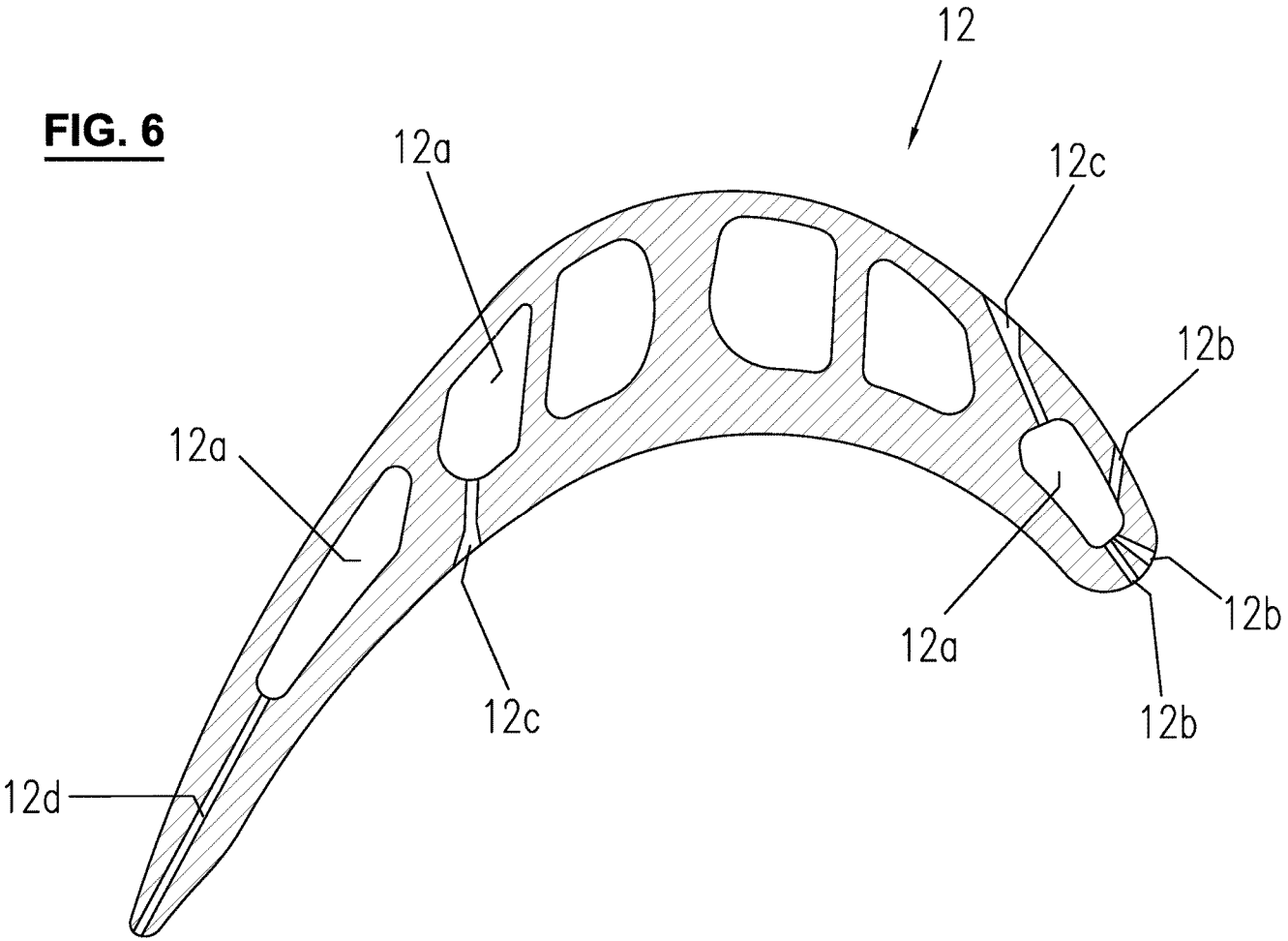
FIG. 6 shows a cross-sectional view of one example of a turbine blade as a workpiece.

FIG. 6 shows one example of a produced workpiece 12 having multiple cavities 12*a*, which are connected to the outer surface via drilled holes 12*b*, 12*c*, 12*d*. In this example, the workpiece 12 is a turbine blade, which is to be usable for high operating temperatures. By providing the holes 12*b*, 12*c*, 12*d*, air can be blown out at high pressure so as to cool the turbine blade. As can be seen, the holes can end very close to the inner wall sections (see the holes 12*b*), so that the risk of damage is particularly high there. Moreover, the holes can have a shape that is not circular cylindrical (see, for example, the holes 12*c*, which have one end widening toward the outer surface), and/or can have a large length (see hole 12*d*).

In the method described hereafter, the holes to be drilled can be designed as shown in FIG. 6, for example.

For drilling, the arrangement is operated so that the machining jet selectively acts on the workpiece continuously (hereinafter referred to as "continuous mode") or in a pulsed manner (hereinafter referred to as "pulsed mode"). In the continuous mode, the machining jet permanently exits the machining head 10 onto the workpiece 12, wherein abrasive material is continuously admixed to the machining jet. An abrasive liquid jet thus acts continuously on the workpiece 12. In the pulsed mode, either the admixing of the abrasive material is interrupted recurrently, so that only a machining jet made solely of liquid impinges on the workpiece, or the impingement of the entire machining jet onto the workpiece is interrupted recurrently.

Figure 7:
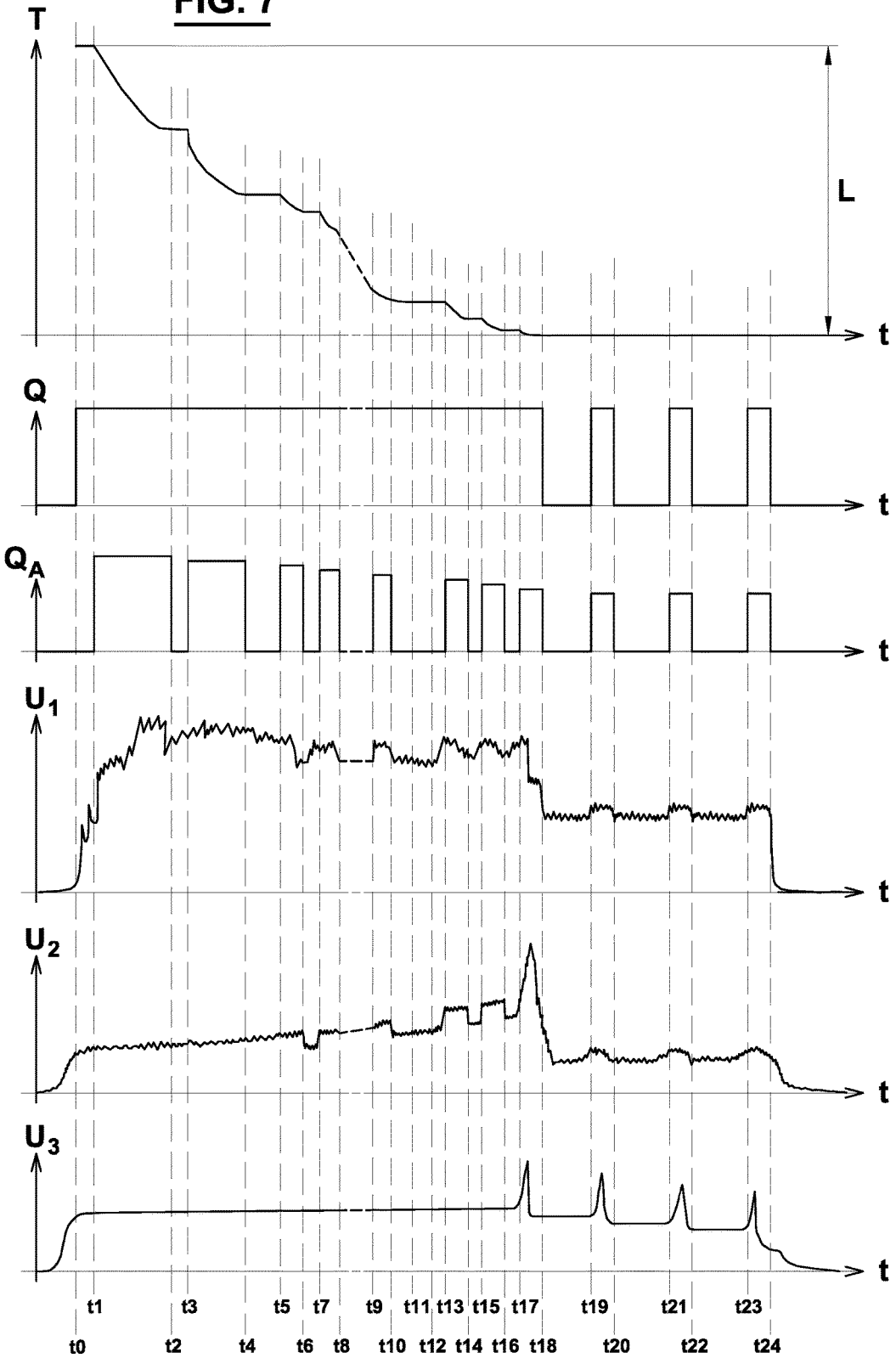
FIG. 7 shows the chronological progression of different process parameters and different measurement signals of sensors, which are used in the arrangement according to FIG. 1.

FIG. 7 shows one example of the chronological progression of the following parameters:

T (for example, in units of millimeters):
hole depth still to be drilled; initially, T corresponds to the total length L of the hole to be drilled, on penetration T=0;

Q (for example, in units of liters per minute): volume flow of the liquid exiting the machining head 10;

$Q_A$ (for example, in units of grams per minute): quantity of abrasive material exiting the machining head 10 per unit of time;

$U_1$ (for example, in units of volts or amperes):
corresponds to the sensor signal for the measured structure-borne noise supplied by the sensor 8;

$U_2$ (for example, in units of volts or amperes):
corresponds to the sensor signal for the acoustic emission in the liquid protective agent supplied by the sensor 7;

$U_3$ (for example, in units of volts or amperes):
corresponds to the sensor signal for the pressure of the liquid protective agent supplied by the sensor 9.

Different times t0, t1, t2, . . . , t24 are marked on the respective time axis t. FIG. 7 does not show the entire progression, but the time axis is interrupted between t8 and t9. During this time interval, the respective progression is similar to the time intervals before or after, for example.

The drilling process begins at time t0. Machining in the example shown here is first carried out in the continuous mode until the drilled depth has reached a certain portion of the total length L of the hole to be drilled. Machining then continues in the pulsed mode. This is the case in the example according to FIG. 7 starting at time t4. Depending on the size of L, machining may also be carried out so that the total length L is drilled in the pulsed mode. This is typically the case for a total length L of no more than 2 mm, and preferably no more than 1 mm and/or at least 8 mm, and preferably at least 10 mm. In the intermediate range, where L is between 1 mm and 10 mm, and preferably between 2 mm and 8 mm, machining may be carried out so that a portion of the total length L is drilled in the continuous mode and a portion of the total length L is drilled in the pulsed mode.

It is also conceivable to interrupt the supply of abrasive material within the continuous mode. For example, depending on the depth of the hole to be drilled, it is possible that abrasive material collects on the resulting drilling end which is advanced by the machining jet. This may have a cushioning effect, so that the machining jet impinges on the workpiece with reduced energy. So as to deliver this collected abrasive material out of the drilling end, it is possible to interrupt the supply of abrasive material once or multiple times during the continuous mode, so that the hole drilled up until then is washed out solely with liquid. In FIG. 7, this interruption in the curve $Q_A$ is shown by way of example in the time interval t2 to t3.

In the pulsed mode, the entire machining jet is switched off intermittently, or only the supply of abrasive material. The latter—as explained above—may be necessary to wash collected abrasive material out of the drilled hole. In the example according to FIG. 7, the interruption in the supply of abrasive material during the time interval t10 to t13 can be seen.

The pulsed mode during drilling is designed so that the pulse width (for example, interval from t12 to t13) is smaller than the time interval between the pulses (for example, interval from t13 to t14). Typically, the duration of the pulses ranges from 80 to 200 milliseconds, while the duration of the interruption between the pulses ranges from 50 to 120 milliseconds.

When the machining jet now penetrates the wall of the workpiece, the measurement signals supplied by the sensor means 7, 8, 9 change noticeably. In the example according to FIG. 7, this is the case shortly after the time t17, where the respective signal $U_1$, $U_2$, $U_3$ decreases or increases considerably. Machining is then interrupted, and the hole is thereafter only machined with a certain predetermined number of pulses of the machining jet. In the example according to FIG. 7, these are 3 pulses. Depending on the application purpose, the number may be higher or lower. These subsequent pulses ensure that the outlet opening of the hole is widened to the desired final diameter. The length of the individual pulses is preferably selected smaller during reshaping than the length of the pulses prior to penetration. In FIG. 7, for example, this means that the time interval t13 to t14 is preferably larger than the time interval t19 to t20. Finally, the drilling operation is terminated, which in the example according to FIG. 7 is at time t24.

In the example according to FIG. 7, the parameter Q always reaches the same level, while $Q_A$ decreases over time. Depending on the application purpose, it is possible to set other levels for Q and/or $Q_A$ during drilling.

So as to be able to carry out the drilling in a controlled manner, a mathematical model is employed, for example, which determines the process parameters, for example from the parameters of the hole to be drilled, such as the depth and shape. Such process parameters are, for example: material sizes such as thickness and composition, the length L of the respective hole to be drilled, the measured values for the position coordinates of the workpiece surface, the amounts of Q and $Q_A$ as a function of the drilling depth T, the pressure of the liquid delivered by the pump device 4, the time where a transition is made from the continuous to the pulsed mode (in the example according to FIG. 7, this is time t4), the times where the drilled hole is washed out only by a machining jet (in the example according to FIG. 7 between t2 and t3 and between t11 and t12), the width of the pulses and pulse rate, the number of pulses after penetration (in the example according to FIG. 7, three pulses), the pressure of the protective agent with which the workpiece is being filled. Another process parameter may also be the angle $\alpha$ at which the machining jet impinges on the surface of the workpiece. It is also possible for this angle $\alpha$ to vary during drilling of the same hole. For example, in the case of holes 12*c* in FIG. 7, the machining jet is first positioned somewhat flatter and then steeper, so as to shape the widening close to the outer surface, before the jet is set to the final angle so as to drill the remaining part of the hole.

The mathematical model can be created based on measurement results, for example, which were gained from drilling test holes into a workpiece.

In one continuation of the method, the cavities of the workpiece are filled with a protective agent in the form a liquid, such as water. When the machining jet now penetrates a wall section, it is cushioned by the liquid protective agent so that it impinges with decreased energy on a wall section disposed behind a hole, as seen looking in the drilling direction. This wall section is thus protected from damage.

The outside openings leading into the cavities are sealed for the filling of the workpiece, so that protective agent can be pumped into the cavities via at least one feed line. In FIG. 1, for example, the flange 27 is used to provide sealing action and the port 26 is used to introduce the protective agent.

After the first hole has been drilled, protective agent exits the same. In the example according to FIG. 1, this agent can be collected in the basin 1*b* and pumped through the workpiece in a circulating manner.

If the hole is reshaped after penetration by way of individual pulses, the respective time interval between the pulses is typically selected to be larger than the lengths of the individual pulse. (In the example according to FIG. 7, the time interval of the interruption from t20 to t21 is greater than the pulse length from t19 to t20.) It is thus achieved that the action of one pulse on the protective agent has subsided in such a way that the same has an optimal cushioning effect again for the next pulse to as great an extent as possible. The interruption is preferably also selected in such a way that, in the case of a potential opening of the pressure control valve of the valve means 28, this valve is closed again before the next pulse is initiated.

In one continuation of the method, the instantaneous flow of the protective agent out of the drilled hole can be used to evaluate the quality of the drilled hole. For example, using the desired dimension of the hole to be drilled, it is possible to determine the flow rate $Q_s$ of protective agent through the pump that is to be expected (for example, in units of liters per minute). The instantaneous flow can be determined by way of a flowmeter. If this flow rate is considerably different from the expected value $Q_s$, in particular considerably smaller, it can be concluded that the hole does not have the desired dimension and thus may have to be reworked. It is also conceivable to evaluate the shape of the jet with which the protective agent exits the hole after penetration, for example optically by way of a laser (for example, that of the measuring device 19) or a camera. For example, if the hole is too small, the jet will not shoot as far out of the workpiece surface as expected.

Quality control based on the flow of the protective agent is particularly helpful when drilling a plurality of holes into the workpiece, since complex measuring of all holes after drilling may thus be dispensed with.

Figure 8:
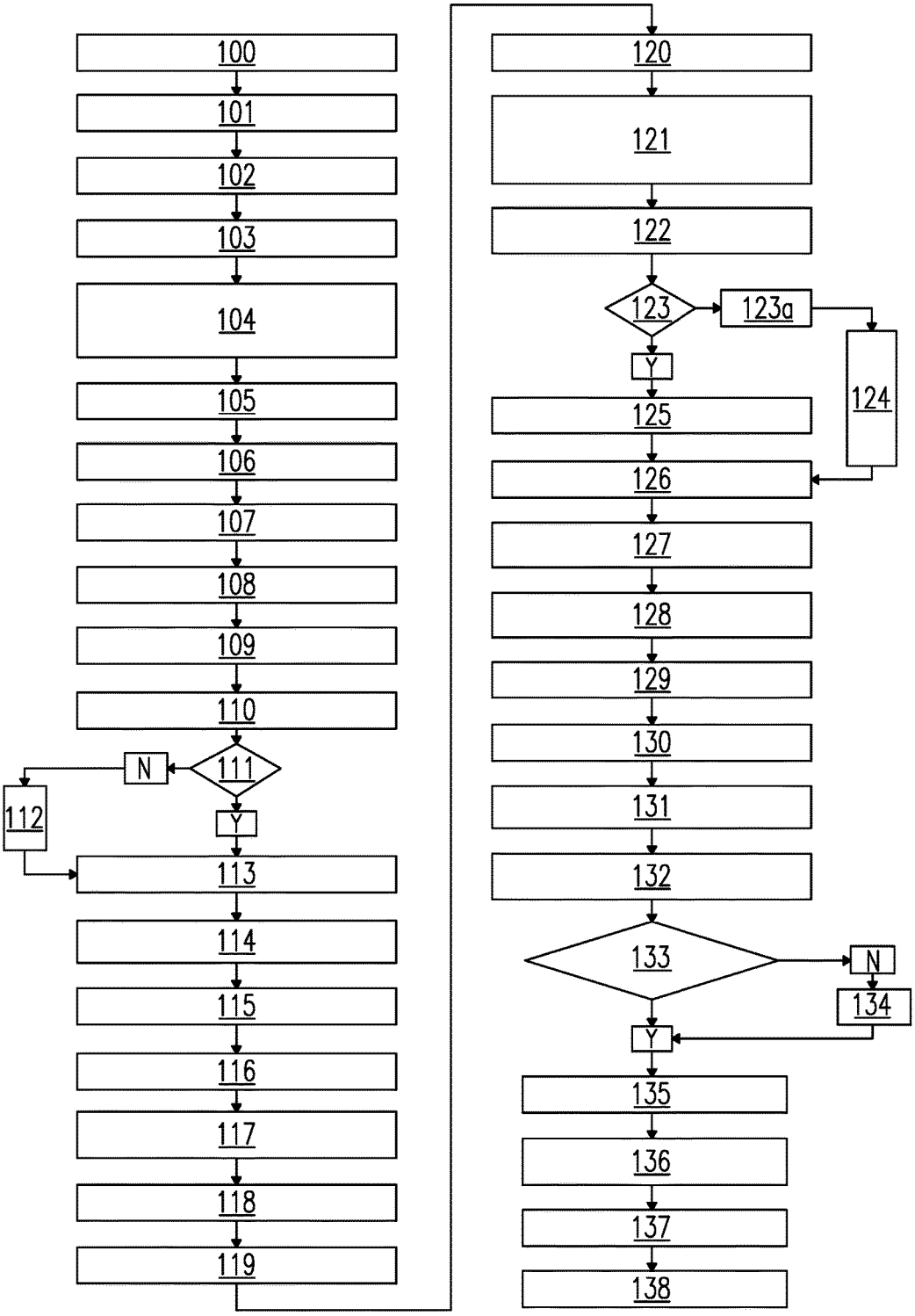
FIG. 8 shows one example of the flow of a method for drilling holes.

FIG. 8 shows one example of a flow of the method, in which a plurality of holes is drilled into a turbine blade as the workpiece, the holes being disposed in multiple rows. The individual method steps 100, 101, 102 and so forth will be described in greater detail hereafter. In the branches 111, 123 and 133, Y denotes "Yes" and N denotes No in response to a decision.

100: The turbine blade is prepared, to include sealed, so as to allow filling with the protective agent, and

101: is chucked into the holding device 11.

102: The turbine blade is measured by way of the measuring device 19. In this way, for example, the instantaneous position coordinates of the blade surface relative to the origin of coordinates are determined so as to be able to position the machining head precisely at the desired locations for the drilling of the holes.

103: The program is now created and/or adapted according to the data obtained in step 102 so as to provide the presently chucked turbine blade with holes at the desired locations.

104: The turbine blade is filled with free-flowing protective agent. In the example according to FIG. 2, this is done via the port 26 and through the chuck 21.

105: It is checked whether the turbine blade is sealed, so that no protective agent leaks.

106: The protective agent is pressurized using pressure p. The valve 28 is opened for venting.

107: The means for monitoring the pressure p are set.

108: The feed device 40 is located in the position in which no abrasive material can make its way to the machining head 10. In the example according to FIG. 3, the sliding part 46 is located in the position in which the bypass channel 46*b* is connected to the inlet 45.

109: The conveyor belt 44 is switched on.

110: The flow rate of abrasive material is monitored and

111: checked to the effect of whether the flow rate is acceptable, which is to say constant. If this is not the case (branch with "N"), then

112: a fault exists, which the user eliminates. In the other case (branch with "Y"),

113: the process is cleared for continuation.

114: The machining head 20 moves to the drilling position and is oriented so that the machining jet can impinge on the workpiece surface at the desired angle.

115: The sensor means 7, 8, 9 are switched on.

116: The pump device 4 for generating the high pressure is switched on.

117: The pressure of the liquid delivered by the pump device 4 is set and monitored.

118: The high-pressure valve 31 is opened.

119: The drilling operation is started according to the process specifications.

120: The metering device 42 is set so that abrasive material makes its way the machining head 10.

121: Drilling is carried out in the continuous mode, or pulsing is already carried out, depending on the hole length to be drilled. In the example according to FIG. 3, the pulsed mode is carried out by moving the sliding part 46 and/or by actuating the high-pressure valve 31.

122: The first drilling operation is terminated at the calculated time.

123: It is continually checked to ensure that the penetration through the wall has not yet taken place. If the penetration occurs sooner than expected (branch 123*a*),

124: a fast shut-down of the machining jet is carried out. In the other case (branch with "Y"),

125: drilling continues in the pulsed mode until the penetration is detected.

126: The drilled hole is shaped using few pulses.

127: Optionally, the hole is machined further, for example using additional pulses, if the process specifications require this and/or the evaluation of the shape of the hole does not yet show the desired quality.

128: A move to the next location on the workpiece takes place so as to drill the next hole, whereby

129: the process restarts with step 108.

130: Steps 108 to 129 are repeated until the holes in the same row are drilled.

131: The pressure p of the protective agent is set, and the flow rate of the protective agent through the row of drilled holes is measured and compared to the expected value. As an alternative or in addition,

132: the height is measured, up to which the protective agent exits the respective hole in the form a jet and is compared to the expected value. The measurement is carried out, for example, with the aid of the measuring device 19, which comprises a laser.

133: It is checked whether the comparison in step 131 or 132 is within the tolerance. If not (branch with "N"),

134: the hole in question is faulty and is reworked using additional pulses. Optionally, the process is adapted, for example by adapting the program in step 103. If the measurement result is within the tolerance range (branch with "Y"),

135: the next row is drilled.

136: The drilling process is repeated until all the desired holes are drilled.

137: The workpiece 12 is cleaned so as to remove the abrasive material, for example.

138: The drilled holes are subjected to a final inspection by again measuring the flow rate of the protective agent through the holes and comparing this to the expected value.

Numerous modifications are available to a person skilled in the art from the above description without departing from the scope of protection of the invention as defined by the claims.

In the above-described exemplary embodiment, for example, the machining head 10 can be moved in multiple axes, while the holding device 11 can only be rotated about one rotational axis. Depending on the application purpose, the number of axes about which the machining head and holding device can be moved may be different, so as to allow a relative movement between the machining head and the workpiece. In one variant, for example, the machining head 10 can be arranged in a stationary manner, while the holding device is movable about multiple axes, for example about three translational axes and two rotational axes. The holding device can be designed as a robotic arm, for example.

In the above-described exemplary embodiment, the workpiece 12 is horizontally oriented. The arrangement can also be designed so that the workpiece 12 is held in a different position, for example also extending vertically.

The example according to FIG. 2 shows three sensors 7, 8, 9 for detecting the penetration. In this way, redundancy in the measurement is achieved. The number of sensors may also be different and can be one, two or more.

In the above-described exemplary embodiment, the flow of the protective agent through the drilled hole is used to assess the quality of the hole. It is also conceivable to use a different medium. For example, air can be conducted through a respective hole, and the flow thereof can be recorded. If deviations from the theoretical value are measured, the shape of the hole, such as the minimum diameter thereof, does not correspond to the desired dimensions. The hole can be appropriately reworked.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A machining arrangement for drilling at least one hole into a front wall section of a workpiece by way of a machining jet, the front wall section being located in front of a rear wall section of the workpiece, as seen looking in a drilling direction, the rear wall section being disposed with an intermediate space at a distance from the front wall section, wherein the machining arrangement can be switched between a continuous mode, in which the machining jet formed from liquid and abrasive material continuously impinges on the workpiece, and a pulsed mode, in which the machining jet is pulsed, so that the impingement of at least one of said liquid and said abrasive material on the workpiece is recurrently interrupted, the machining arrangement comprising i) a controller which is programmed and configured so that said at least one hole is drilled at least partially in the pulsed mode and ii) a filling device for filling the workpiece, before the drilling, with a free-flowing protective agent to be pressurized.

2. The machining arrangement according to claim 1, wherein the filling device includes a port for introducing the protective agent, the port being arranged on a holding device for holding a workpiece.

3. The machining arrangement according to claim 1, further comprising a pressure sensor for measuring the pressure of the protective agent in a workpiece.

4. The machining arrangement according to claim 1, further comprising a sensor device for detecting a time when the machining jet penetrates a wall of the workpiece, wherein the sensor device comprises at least one of the following configurations:

it is configured to detect oscillations in a solid body,
it is configured to detect oscillations in a liquid,
it is configured to detect oscillations in air,
it comprises an acoustic emission sensor,
it comprises a microphone.

5. The machining arrangement according claim 1, further comprising a feed device for feeding abrasive material, the feed device comprising at least one of the following components:

an appliance for determining the fed quantity of abrasive material,
a bypass channel through which abrasive material can be conducted so as to interrupt an admixing to the machining jet.

6. The machining arrangement according to claim 5, wherein the bypass channel comprises at least one of the configurations:

it is configured to be moved back and forth between two positions, and
it is connected to an outlet so as to discharge abrasive material.

7. The machining arrangement according to claim 1, further comprising a machining head from which the machining jet exits during operation, and a holding device which includes a holding head for holding the workpiece, the machining head and the holding head being translationally and rotationally movable relative to one another.

8. The machining arrangement according to claim 7, wherein said relative movement between the machining head and the holding head comprises three translational axes and at least two rotational axes.

9. A machining arrangement for drilling at least one hole into a front wall section of a workpiece by way of a machining jet, the front wall section being located in front of a rear wall section of the workpiece, as seen looking in a drilling direction, the rear wall section being disposed with an intermediate space at a distance from the front wall section, wherein the machining arrangement can be switched between a continuous mode, in which the machining jet formed from liquid and abrasive material continuously impinges on the workpiece, and a pulsed mode, in which the machining jet is pulsed, so that the impingement of at least one of said liquid and said abrasive material on the workpiece is recurrently interrupted, the machining arrangement comprising i) a controller which is programmed and configured so that said at least one hole is drilled at least partially in the pulsed mode and ii) a sensor device for detecting a time when the machining jet penetrates a wall of the workpiece, wherein the sensor device comprises at least one of the following configurations:

it is configured to detect oscillations in a solid body, it is configured to detect oscillations in a liquid, and it is configured to detect oscillations in air.

10. The machining arrangement according to claim 9, wherein the sensor device comprises at least one of the group consisting of an acoustic emission sensor and a microphone.

11. A machining arrangement for drilling at least one hole into a front wall section of a workpiece by way of a machining jet, the front wall section being located in front of a rear wall section of the workpiece, as seen looking in a drilling direction, the rear wall section being disposed with an intermediate space at a distance from the front wall section, wherein the machining arrangement can be switched between a continuous mode, in which the machining jet formed from liquid and abrasive material continuously impinges on the workpiece, and a pulsed mode, in which the machining jet is pulsed, so that the impingement of at least one of said liquid and said abrasive material on the workpiece is recurrently interrupted, the machining arrangement comprising i) a controller which is programmed and configured so that said at least one hole is drilled at least partially in the pulsed mode and ii) a feed device for feeding abrasive material, the feed device comprising an appliance for determining a fed quantity of abrasive material.

12. The machining arrangement according to claim 11, wherein the feed device includes a conveyor belt.

13. The machining arrangement according to claim 11, wherein the feed device includes a branch part for directing abrasive material to the machining head, the branch part including an inlet for receiving a process gas.

14. The machining arrangement according to claim 13, wherein the branch part includes a sensor for detecting liquid flowing back from the machining head.

15. The machining arrangement according to claim 11, wherein the appliance includes a strain gauge configured to deform by abrasive material dropping thereon and to supply a measurement signal.

16. A machining arrangement for drilling at least one hole into a front wall section of a workpiece by way of a machining jet, the front wall section being located in front of a rear wall section of the workpiece, as seen looking in a drilling direction, the rear wall section being disposed with an intermediate space at a distance from the front wall section, wherein the machining arrangement can be switched between a continuous mode, in which the machining jet formed from liquid and abrasive material continuously impinges on the workpiece, and a pulsed mode, in which the machining jet is pulsed, so that the impingement of at least one of said liquid and said abrasive material on the workpiece is recurrently interrupted, the machining arrangement comprising i) a controller which is programmed and configured so that said at least one hole is drilled at least partially in the pulsed mode and ii) a feed device for feeding abrasive material, the feed device comprising a bypass channel through which abrasive material can be conducted so as to interrupt an admixing to the machining jet.

17. The machining arrangement according to claim 16, wherein the bypass channel comprises at least one of the configurations:

it is configured to be moved back and forth between two positions, and it is connected to an outlet so as to discharge abrasive material.

18. The machining arrangement according to claim 16, wherein the feed device includes a conveyor belt.

19. The machining arrangement according to claim 16, wherein the feed device includes a branch part for directing abrasive material to the machining head, the branch part including an inlet for receiving a process gas.

20. The machining arrangement according to claim 19, wherein the branch part includes a sensor for detecting liquid flowing back from the machining head.

21. A machining arrangement for drilling at least one hole into a front wall section of a workpiece by way of a machining jet, the front wall section being located in front of a rear wall section of the workpiece, as seen looking in a drilling direction, the rear wall section being disposed with an intermediate space at a distance from the front wall section, wherein the machining arrangement can be switched between a continuous mode, in which the machining jet formed from liquid and abrasive material continuously impinges on the workpiece, and a pulsed mode, in which the machining jet is pulsed, so that the impingement of at least one of said liquid and said abrasive material on the workpiece is recurrently interrupted, the machining arrangement comprising i) a controller which is programmed and configured so that said at least one hole is drilled at least partially in the pulsed mode, ii) a machining head from which the machining jet exits during operation, and iii) a holding device which includes a holding head for holding the workpiece, the machining head and the holding head being rotatably arranged.

22. The machining arrangement according to claim 21, wherein the machining head and the holding head are translationally and rotationally movable relative to one another.

23. The machining arrangement according to claim 22, wherein said relative movement between the machining head and the holding head comprises three translational axes and at least two rotational axes.

24. The machining arrangement according to claim 21, wherein the machining arrangement further comprises a pump device which is arranged stationary with regard to the machining head and which is configured to conduct liquid to the machining head.

25. The machining arrangement according to claim 21, wherein the machining arrangement further comprises a basin, the holding device being arranged on a wall of the basin.

26. The machining arrangement according to claim 21, wherein the machining head is rotatable about two rotational axes which are disposed at an angle with respect to each other.

27. The machining arrangement according to claim 26, wherein said angle is in range of 45 to 90 degrees.

* * * * *